United States Patent [19]

Teixeira

[11] Patent Number: 4,838,418

[45] Date of Patent: Jun. 13, 1989

[54] HAZARDOUS WASTE CONTAINER

[75] Inventor: Norman J. Teixeira, Santa Maria, Calif.

[73] Assignee: Teixeira Farms, Inc., Santa Maria, Calif.

[21] Appl. No.: 204,702

[22] Filed: Jun. 10, 1988

Related U.S. Application Data

[63] Continuation-in-part of Ser. No. 54,017, May 26, 1987, Pat. No. 4,756,417.

[51] Int. Cl.[4] ..... B65D 19/06; B65D 19/20; B65D 85/84

[52] U.S. Cl. ..... 206/386; 108/55.1; 220/457; 229/23 R; 229/191; 229/918

[58] Field of Search ..... 108/51.3, 55.1; 206/320, 386, 594–600; 220/457; 229/23 R, 191, 918, 919

[56] References Cited

U.S. PATENT DOCUMENTS

| | | | |
|---|---|---|---|
| 2,753,101 | 7/1956 | Zimmerman | 206/598 |
| 2,895,661 | 7/1959 | Budd | 206/599 |
| 3,237,760 | 3/1966 | Remer et al. | 108/55.1 |
| 3,395,823 | 8/1968 | Langston | 206/511 |
| 3,502,237 | 3/1970 | Verhein et al. | 206/598 |
| 3,545,641 | 12/1970 | Olson | 206/511 |
| 3,777,969 | 12/1973 | Nurre | 229/23 R |
| 3,828,964 | 8/1974 | Bonnot | 206/600 |
| 3,877,786 | 4/1975 | Booras et al. | 40/208 |
| 4,368,674 | 1/1983 | Wiens et al. | 220/72 |
| 4,756,417 | 7/1988 | Teixeira | 206/386 |

FOREIGN PATENT DOCUMENTS

| | | | |
|---|---|---|---|
| 0028300 | 3/1977 | Japan | 206/509 |
| 0530909 | 1/1973 | Switzerland | 206/23 R |
| 0433058 | 8/1935 | United Kingdom | 206/23 R |
| 2011357 | 7/1979 | United Kingdom | 229/23 C |

*Primary Examiner*—Jimmy G. Foster
*Attorney, Agent, or Firm*—Daniel C. McKown

[57] ABSTRACT

A container for hazardous waste is formed of corrugated cardboard that is coated on both sides with fiberglass. The carboard includes flaps that are bent prior to being coated to form triangular braces that extend along the edges of the container. The container is extremely durable, impervious to a wide range of chemicals, and economical to manufacture. In one embodiment, suitable for use where greater protection is required, a smaller container made by the same technique is lowered into a larger container of the same type, and the space between the inner and outer containers is filled with a liquid foam plastic. When the foam plastic has cured, it serves to prevent movement of the inner container with respect to the outer container, to provide thermal insulation, and to protect against shock and breakage of the inner container.

3 Claims, 3 Drawing Sheets

HAZARDOUS WASTE CONTAINER

BACKGROUND OF THE INVENTION

Reference to Related Application

This application is a continuation-in-part of Ser. No. 07/054,017 filed May 26, 1987, for PRODUCE BIN, now U.S. Pat. No. 4,756,417.

The benefit of the filing date of the earlier application is claimed for subject matter common to this application and the earlier application. The contents of the earlier application are hereby incorporated by reference into this application.

Field of the Invention

The present invention is in the field of containers and specifically relates to a sturdy container for transporting and storing hazardous waste. The container is formed of a composite structural material that includes corrugated cardboard coated with a thick layer of resin impregnated with glass fibers. The resulting structure is economical to produce and resistant to damage from rough use.

The Prior Art

Although much work has been done in the field of containers, the unique structure of the present invention does not appear to be known in the prior art.

In U.S. Pat. No. 4,280,640, Daloisio shows an integral double-wall container that includes inner and outer walls of polyethylene, between which a urethane foam is included. This container is made by a rotational molding process.

In U.S. Pat. No. 3,854,620, Saidla shows a container structure in which at least some of the walls have an outer fiberglass skin, an inner fiberglass skin, and a layer of plastic foam between the outer skin and the inner skin, as best seen in FIGS. 2 and 16 of the patent.

In U.S. Pat. No. 3,989,562, Hladik, et al. show a large container whose body includes an inner tube formed of a wound laminate of synthetic resin-impregnated material, an outer tube formed of a wound laminate of synthetic resin-impregnated material, and an insulation material in the space between the tubes.

In U.S. Pat. No. 4,368,674, Wiens, et al., describe a hatch cover that employs a honeycomb structure formed by a stack of alternating flat and serpentine paperboard strips. The patent teaches coating the strips with resin.

In U.S. Pat. No. 3,545,641, Olson describes a fiberglass storage bin.

In U.S. Pat. No. 3,738,527, Townsend shows a wall of a container that includes an outer layer of steel, an inner layer of fiberglass, and an intermediate layer of plastic foam.

In U.S. Pat. No. 4,100,860, Gablin, et al. show a container wall that has spaced inner and outer shells with a layer of foamed polyurethane occupying the space between the inner and outer shells, both of which are made of metal.

In U.S. Pat. No. 4,165,806, Cayton shows a pallet to which compression-resistant vertical members are attached.

In U.S. Pat. No. 4,445,614, Mitsumori, et al. show a pallet formed of corrugated board and onto which a bottomless corrugated fiberboard container is placed, so that the top of the cardboard pallet serves as the bottom of the box.

None of the above patents shows the advantageous combination of features used in the present invention.

SUMMARY OF THE INVENTION

A first objective of the present invention is to provide a hazardous waste container that is safe for use in transporting and storing relatively small quantities of hazardous waste material.

An important factor in achieving a safe container is that the container must safely withstand the foreseeable abuse to which it may be subjected. For example, the container may accidentally be dropped from a forklift, or may accidentally fall off a truck in transit. The container should be able to withstand these mishaps without losing any of its contents.

This ability to withstand rough usage requires strength, but strength alone is not the only consideration. In addition to strength, the container must possess toughness and resiliency. The type of construction described below possesses these qualities to an admirable degree, as has been learned from experience with the produce bin described in the parent application, now U.S. Pat. No. 4,756,417.

The hazardous waste container of the present invention is formed of the same material as the produce bin, namely, corrugated cardboard that has been coated with a layer of fiberglass.

Because the hazardous waste containers should not be stacked, they do not require the ability to support the heavy vertical loads for which the produce bin was designed. Accordingly, in the hazardous waste container, a simplied edge-reinforcing system is employed.

It is a further object of the present invention to provide a container that is impervious to a wide variety of chemicals. In accordance with the present invention, the interior of the container is coated with a layer of fiberglass, which is compatible with a wide range of chemicals.

It is a further objective of the present invention to provide a hazardous waste container that is economical to manufacture. It is recognized that such containers will probably not be reused, and they may even be destroyed when the hazardous contents are disposed of. Therefore, the container should be of a low cost construction.

As will be seen below, these criteria are met very well by the structure of the present invention.

The novel features which are believed to be characteristics of the invention, together with further objects and advantages thereof, will be better understood from the following description considered in connection with the accompanying drawings in which two preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
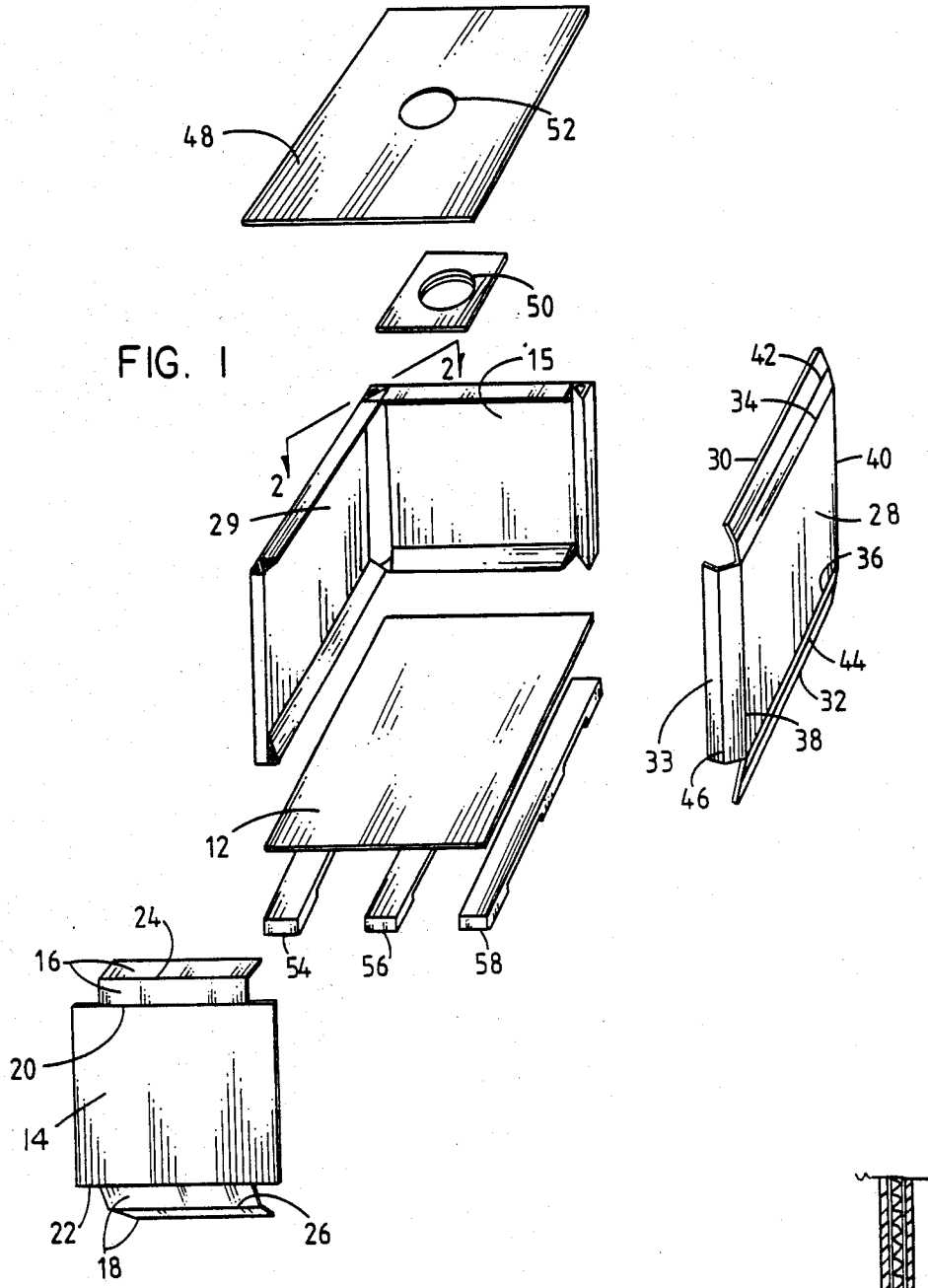
FIG. 1 is an exploded perspective view showing a first preferred embodiment of the present invention.

Turning now to the drawings, in which like parts are denoted by the same reference numeral throughout, a first preferred embodiment of the invention is shown in FIG. 1.

The major components of that embodiment are a bottom 12 two ends 14 and 15, two sides 28 and 29, a top 48 and a port 50.

The bottom 12 is a flat sheet of corrugated cardboard of the type commonly used in shipping merchandise. This material is also referred to as corrugated fiberboard and sometimes simply as cardboard.

The ends 14, 15 are identical. The end 14 includes a flat, generally rectangular sheet of corrugated cardboard from which flaps 16 and 18 extend at the upper edge 20 and the lower edge 22 respectively. As shown in FIG. 1, the flaps 16 and 18 each include two sections which are divided by the lines 24 and 26 respectively.

The sides 28 and 29 are identical. The side 28 is formed of flat corrugated cardboard. Four flaps extend from the upper, lower, left, and right edges 34, 36, 38, and 40, respectively. The flap on the right-hand side of the side 28 is not visible in FIG. 1, but it is the mirror image of the flap 33.

The container of FIG. 1 also includes a top 48 that is a flat sheet of corrugated cardboard having an aperture 52 in it. The port 50 is affixed to the top 48 in alignment with the aperture 52.

Figure 2:
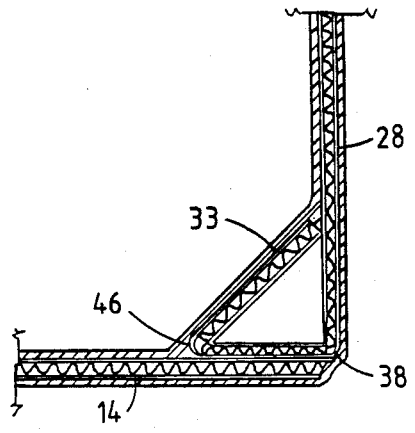
FIG. 2 is a fractional cross-sectional view in the direction 2—2 indicated in FIG. 1.

The construction of the container is quite straightforward, as illustrated by FIG. 2, which is a fractional cross-sectional view in the direction 2—2 shown in FIG. 1. The flap 33 is first folded about the line 46 and then folded about the edge 38 to form the triangular shoulder shown in FIG. 2. All of the other flaps of the sides and ends are folded in a similar manner. The resulting shoulders of triangular cross-section that are formed along the edges of the sides and ends serve as braces to add strength and rigidity to the container. The flaps are held in their folded position and a layer of fiberglass is applied to the exposed surfaces of the individual ends and sides. After this applied fiberglass layer has cured, the sides and ends are brought together over the bottom 12, and are held together by a second application of fiberglass, which serves to bond the ends 14 and 15 to the sides 28 and 29, as illustrated in FIG. 2. Also, a coating of fiberglass is applied to the parts of the bottom adjacent its edges, to secure the ends and sides to the bottom. Thereafter, liquid resin is applied to the top side of the triangular braces adjacent the upper edges of the ends and sides, and the top 48 is then lowered into position.

The port 50 is bonded to the top 48 by a coating of liquid resin. When the resin cures, the port is securely fastened to the top 48.

Liquid resin, mixed with glass fibers is sprayed through the aperture 52 and directed against the interior surfaces of the container, with special care being taken to insure that the edges are thoroughly sealed.

Although the container could be built without a pallet, in the preferred embodiment a pallet is included. In the preferred embodiment, the pallet is formed by fastening three beams 54, 56, 58 to the underside of the bottom 12.

Figure 3:
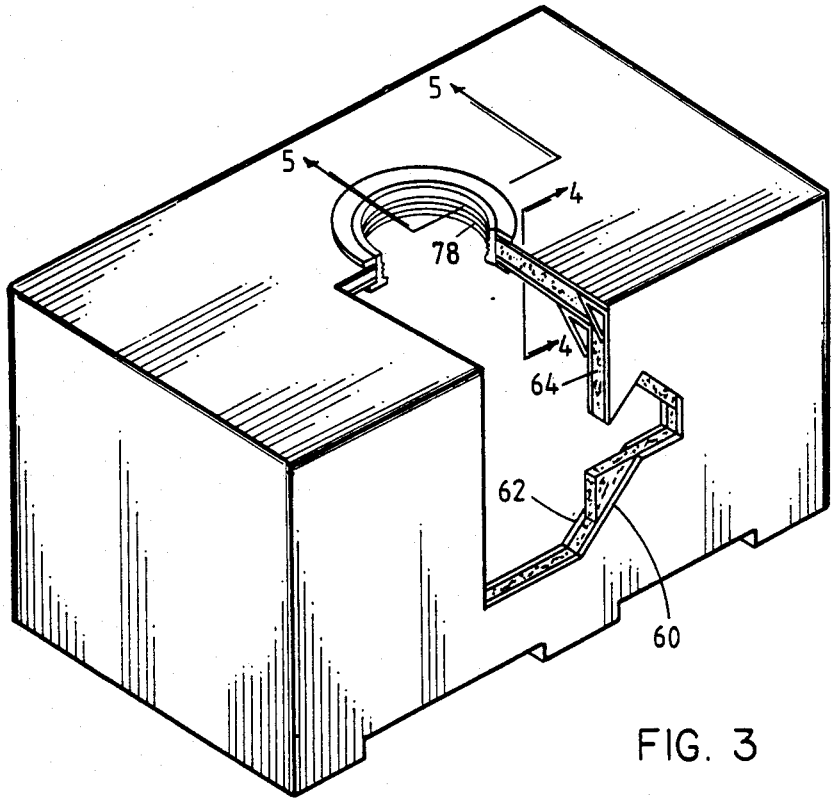
FIG. 3 is a perspective view showing a second preferred embodiment of the present invention.

FIG. 3 is a perspective view partially cut away to show the construction of a second preferred embodiment of the present invention. That embodiment is notable for having a double wall construction.

Figure 4:
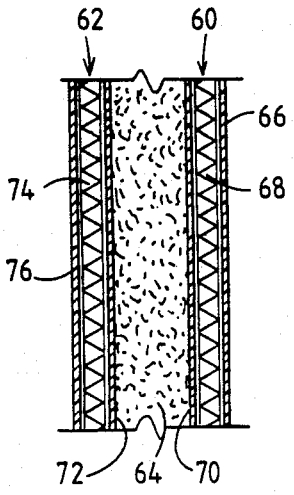
FIG. 4 is a fractional cross-sectional view in the direction 4—4 indicated in FIG. 3.

In accordance with the invention, the embodiment of FIG. 3 can be constructed by building two containers of the type shown in FIG. 1, with the outside dimensions of one of the containers being sufficiently small to permit that container to be lowered into the second similar container. The pallet is included, and it serves to keep the bottom of the inner container spaced from the bottom of the outer container. Because of the difference in size in the containers, there exists a space between the outer wall of the inner container and the inner wall of the outer container. This space is then filled with a liquid foam plastic, such as polystyrene. When the liquid foam has cured, the inner and outer containers are bonded together by the foamed plastic. FIG. 4 is a fragmentary cross-sectional view of the wall of the double wall container of FIG. 3. It includes an outer wall 60, and an inner wall 62, and a layer of foam plastic 64 occupying the space between the outer wall and the inner wall. As in the embodiment of FIG. 1, the outer wall includes an outer layer 66 of fiberglass, core of corrugated cardboard 68, and an inner layer of fiberglass 70. Likewise, the inner wall 62 also includes an outer layer 72 of fiberglass, a core 74 of corrugated cardboard, and an inner layer 76 of fiberglass.

In the embodiment of FIGS. 3 and 4, the layer 64 of foam plastic serves to prevent movement of the inner container with respect to the outer container. It also provides thermal insulation and it serves as a shock absorber.

The double walled embodiment shown in FIG. 3 and 4 provides greater protection than the embodiment shown in FIG. 1 because even if the outer wall is damaged, the inner wall will still provide adequate protection from the hazardous material.

Figure 5:
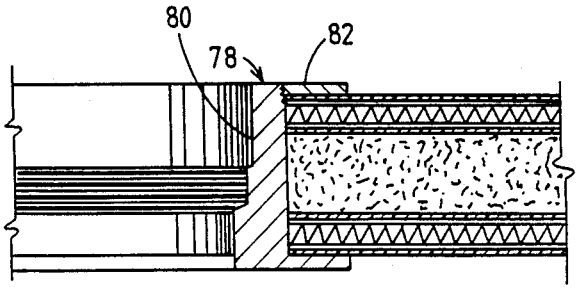
FIG. 5 is a fractional cross-sectional view in the direction 5—5 indicated in FIG. 3.

As shown in FIG. 5, in the double wall embodiment, the port 78 includes a neck 80 that extends through the space between the inner container and the outer container. The outer end of this neck is threaded to receive a retaining ring 82.

Figure 6:
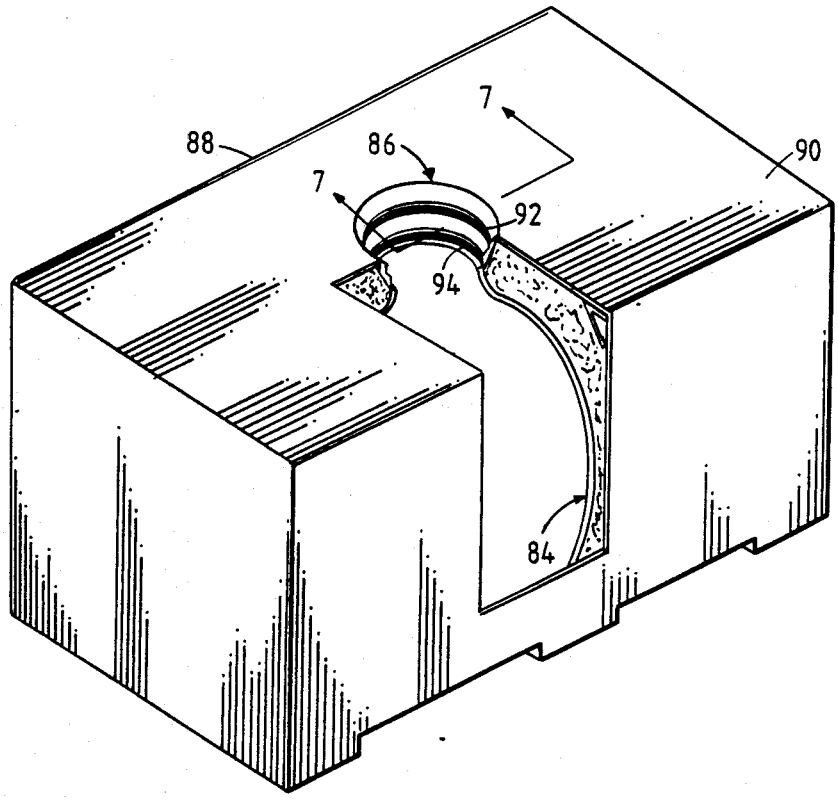
FIG. 6 is a perspective view showing a third preferred embodiment of the present invention; and, FIG. 7 is a fractional cross-sectional view in the direction 7—7 indicated in FIG. 6.
Figure 7:
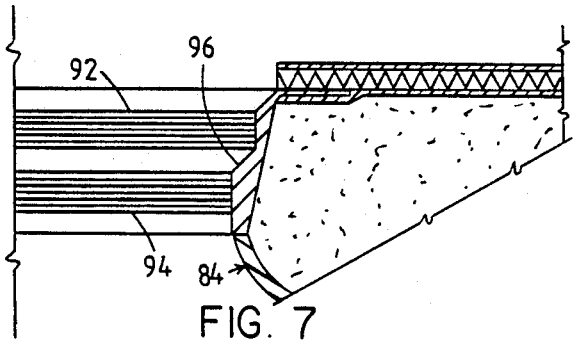

FIGS. 6 and 7 show a second preferred double wall embodiment, which differs from the embodiment of FIG. 3 in the structure of the inner wall 84 and in the structure of the port 86.

In this embodiment, the inner wall 84 is not formed from corrugated cardboard, but instead is formed by spraying liquid resin and lengths of glass fiber onto the surface of a balloon. After the resin has cured, the balloon is removed, leaving a hollow generally spherical shell, which is used as the inner wall 84. This shell is then mounted inside a container 88 of the type shown in FIG. 1, the port structure 86 is affixed to the shell and to the top 90, and the space between the shell and container 88 is filled with foam plastic in a liquid state. The foam plastic cures and thereafter prevents movement of the shell with respect to the container, while also insulating the shell and its contents and protecting them from mechanical shock.

The port 86, unlike that shown in FIG. 5 includes a smaller set of threads 94 and a larger set of threads 92 as well as a tapered section 96. As best seen in FIG. 7, a flange 98 on the port 86 is bonded to the top 90 by a layer of fiberglass.

Thus, there have been described both a single wall embodiment and a double wall embodiment of a container for hazardous waste. Both embodiments employ a fiberglass-reinforced corrugated cardboard as their main structural material. The edges of the containers are strengthened by folding the cardboard in such a way as to form triangular braces that extend along the edges. The double walled embodiment includes two single wall containers, one inside the other. The space between the containers is filled with plastic foam.

The containers made in accordance with the present invention are extremely durable and resistant to damage from rough handling. In addition, they are impervious to a wide range of chemicals. Finally, the containers in accordance with the present invention are extremely economical to manufacture.

The foregoing detailed description is illustrative of two embodiments of the invention, and it is to be understood that additional embodiments thereof will be obvious to those skilled in the art. The embodiments described herein together with those additional embodiments are considered to be within the scope of the invention.

What is claimed is:

1. A container for hazardous waste, comprising:

a bottom consisting of a flat rectangular sheet of corrugated board;

a top including a flat rectangular sheet of corrugated board;

two ends, each including a flat generally rectangular sheet of corrugated board having flaps extending from its upper and lower edges, said flaps folded twice in the same direction parallel to the upper edge and lower edge, respectively to form upper and lower laterally-extending shoulders of triangular cross section extending along the upper and lower edges;

two sides, each including a flat generally rectangular sheet of corrugated board having flaps extending from its upper, lower, left and right edges, each of said flaps folded twice in the same direction parallel to the edge it extends from to form upper and lower laterally-extending shoulders of triangular cross section extending along the upper and lower edges and to form vertically-extending shoulders of triangular cross section extending along the left and right edges;

said two ends and said two sides all being of the same height, the left and right edges of said ends overlapping the vertically extending shoulders of said sides and affixed to them, said bottom affixed to the lower laterally-extending shoulders of said two sides and of said two ends, said top affixed to the upper laterally-extending shoulders of said two sides and of said two ends to form a container having an inside surface and an outside surface; and, a layer of resin impregnated with glass fibers covering said inside surface and said outside surface, whereby said container is strengthened, rendered watertight, and rendered impervious to chemical attack by said hazardous waste.

2. The container of claim 1 wherein said top further comprises an aperture and wherein said container further comprises a removable cap adapted to seal said aperture.

3. The container of claim 1 further comprising a pallet affixed to the underside of said bottom.

* * * * *